US010391345B2

(12) United States Patent
Sukhman et al.

(10) Patent No.: US 10,391,345 B2
(45) Date of Patent: Aug. 27, 2019

(54) LASER MATERIAL PROCESSING SYSTEMS CONFIGURED TO SUPPRESS SELF-SUSTAINED COMBUSTION, AND ASSOCIATED APPARATUSES AND METHODS

(71) Applicant: Universal Laser Systems, Inc., Scottsdale, AZ (US)

(72) Inventors: Yefim P. Sukhman, Scottsdale, AZ (US); Stefano J. Noto, Mesa, AZ (US); Christian J. Risser, Scottsdale, AZ (US); Matthew R. Ricketts, Phoenix, AZ (US)

(73) Assignee: UNIVERSAL LASER SYSTEMS, INC., Scottsdale, AZ (US)

( * ) Notice: Subject to any disclaimer, the term of this patent is extended or adjusted under 35 U.S.C. 154(b) by 242 days.

(21) Appl. No.: 14/314,874

(22) Filed: Jun. 25, 2014

(65) Prior Publication Data

US 2015/0165253 A1 Jun. 18, 2015

Related U.S. Application Data

(60) Provisional application No. 61/916,025, filed on Dec. 13, 2013.

(51) Int. Cl.
*A62C 3/00* (2006.01)
*A62C 37/44* (2006.01)

(52) U.S. Cl.
CPC ..... *A62C 37/44* (2013.01); *A62C 3/00* (2013.01)

(58) Field of Classification Search
CPC ..... A62C 37/44; A62C 3/00; A62C 37/00; A62C 37/36; A62C 99/00; A62C 35/02; A62C 35/023; B23K 26/42; B23K 26/14; B23K 26/35; B23K 31/00; F16P 1/06
USPC ..... 169/60, 5, 16, 17; 219/121.62
See application file for complete search history.

(56) References Cited

U.S. PATENT DOCUMENTS 5,659,292 A * 8/1997 Tice ..... G08B 29/183 340/286.05
6,388,228 B1 * 5/2002 Lai ..... B23K 26/10 219/121.6
7,947,919 B2 * 5/2011 Sukhman ..... B08B 7/0042 219/121.67

(Continued)

FOREIGN PATENT DOCUMENTS

JP 11-123581 * 5/1999 ..... B23K 26/10
JP 2004202005 * 7/2004 ..... A26C 3/00

(Continued)

*Primary Examiner* — Darren W Gorman
*Assistant Examiner* — Christopher R Dandridge
(74) *Attorney, Agent, or Firm* — Perkins Coie LLP

(57) ABSTRACT

Embodiments of laser material processing systems with fire suppression are disclosed herein. A laser material processing system configured in accordance with one embodiment includes a laser material processing region, at least one sensor disposed in the laser material processing region, and at least one suppressant delivery port positioned in or adjacent to the laser material processing region. The sensor is configured to detect the presence of self-sustained combustion in the laser material processing region, and a suppressant delivery port is configured to deliver suppressant to suppress the self-sustained combustion when at least one of the sensors detects self-sustained combustion.

20 Claims, 8 Drawing Sheets

(56) References Cited

U.S. PATENT DOCUMENTS

| | | | | |
|---|---|---|---|---|
| 8,079,421 | B2 * | 12/2011 | Wagner | A62C 99/0018 169/11 |
| 8,678,101 | B2 * | 3/2014 | Gatsonides | A62C 3/08 169/16 |
| 2009/0223944 | A1 * | 9/2009 | Sukhman | B08B 7/0042 219/121.84 |
| 2010/0263885 | A1 * | 10/2010 | Tuma | A62C 3/16 169/46 |
| 2010/0300708 | A1 * | 12/2010 | Raphael | A61M 16/04 169/54 |
| 2017/0065840 | A1 | 3/2017 | Shih et al. | |

FOREIGN PATENT DOCUMENTS

| | | | | |
|---|---|---|---|---|
| JP | 2011-003812 | * | 8/2011 | A62C 35/10 |
| KR | 1020120116691 | * | 4/2011 | B23K 26/38 |
| WO | WO2013178281 | * | 12/2013 | B23K 37/006 |

* cited by examiner

LASER MATERIAL PROCESSING SYSTEMS CONFIGURED TO SUPPRESS SELF-SUSTAINED COMBUSTION, AND ASSOCIATED APPARATUSES AND METHODS

CROSS-REFERENCE TO RELATED APPLICATION

The present application claims priority to U.S. Provisional Application No. 61/916,025, filed Dec. 13, 2013, which is incorporated herein by reference in its entirety.

TECHNICAL FIELD

The present disclosure is directed generally to a laser material processing system and, more specifically, to a laser material processing system configured to suppress uncontrolled or self-sustained combustion.

BACKGROUND

Laser material processing involves imparting laser energy to materials, most often for material removal. These materials are often combustible and also generate volatile compounds as liquid or vapor when interacting with a laser beam which creates a potential for fire. Some existing systems can automatically suppress fires in small enclosures, but these existing systems are typically geared towards cutting machinery, such as Computer Numerical Control (CNC) mills and lathes. In most cases, the material being processed in these existing systems (usually metal) is not flammable, and it is typically only the atomized coolant/lubricant that ignites. Further, these conventional systems do not include active fume extraction continuously drawing fresh air through the system.

DETAILED DESCRIPTION

The following disclosure describes various types of laser material processing systems configured to suppress self-sustained combustion and associated apparatuses and methods. As used herein, the term "self-sustained combustion" is used to refer to combustion (e.g., fire) that is uncontrolled or otherwise distinguishable over controlled combustion or non-self-sustained combustion ordinarily produced during the processing of materials and generally confined to the point of interaction between a laser beam and a target material. Certain details are set forth in the following description and FIGS. 1A-8 to provide a thorough understanding of various embodiments of the technology. Other details describing well-known structures and systems often associated with laser material processing systems, however, are not set forth below to avoid unnecessarily obscuring the description of the various embodiments of the disclosure.

Many of the details and features shown in the Figures are merely illustrative of particular embodiments of the technology. Accordingly, other embodiments can have other details and features without departing from the spirit and scope of the present technology. In addition, those of ordinary skill in the art will understand that further embodiments can be practiced without several of the details described below. Furthermore, various embodiments of the technology can include structures other than those illustrated in the Figures and are expressly not limited to the structures shown in the Figures. Moreover, the various elements and features illustrated in the Figures may not be drawn to scale.

In the Figures, identical reference numbers identify identical or at least generally similar elements. To facilitate the discussion of any particular element, the most significant digit or digits of any reference number refer to the Figure in which that element is first introduced. For example, element 110 is first introduced and discussed with reference to FIG. 1A.

Figure 1A:
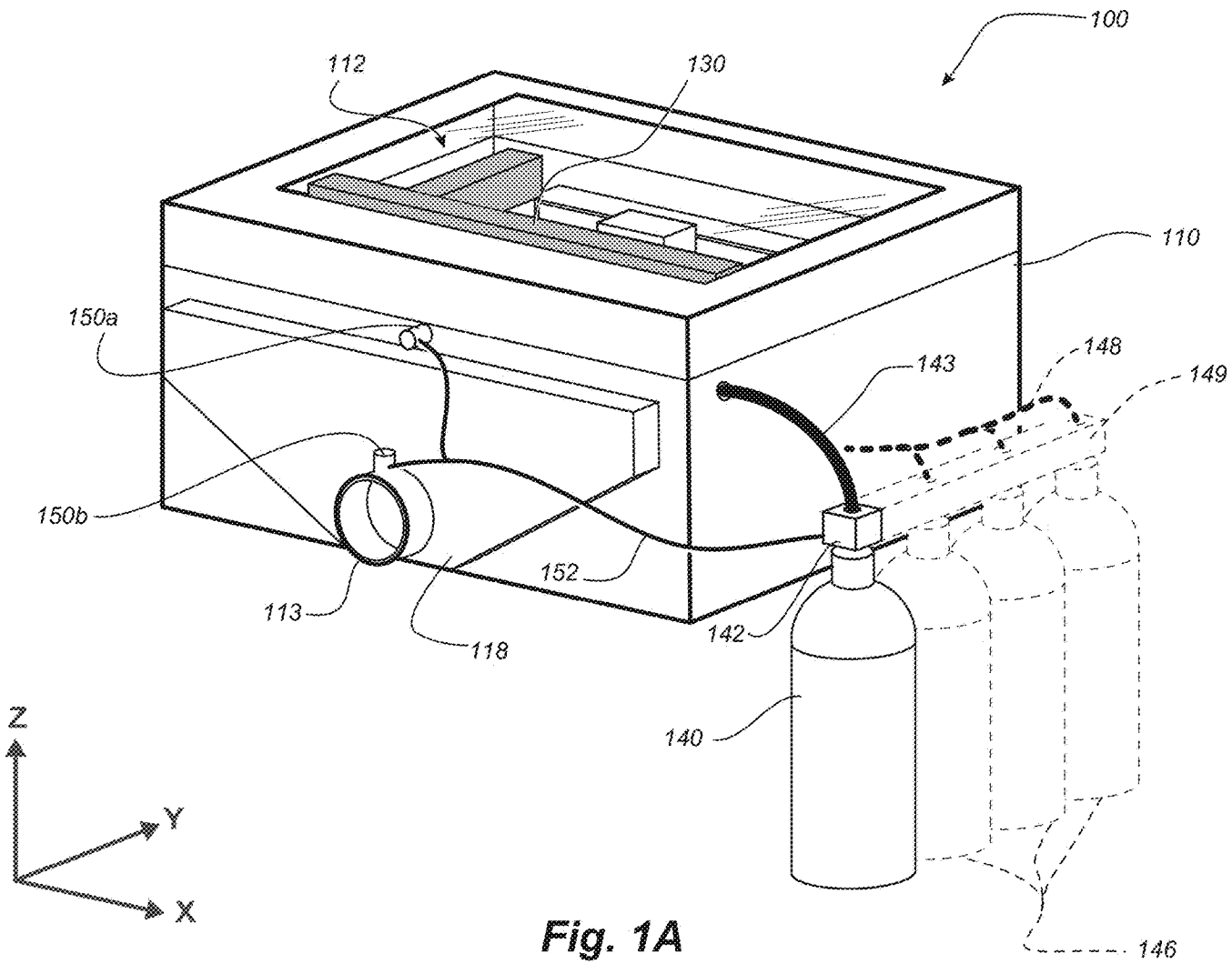
FIG. 1A is an isometric view.

FIG. 1A is an isometric view of a laser material processing system 100 ("processing system 100") configured to suppress self-sustained combustion in accordance with an embodiment of the present technology. As shown, the processing system 100 includes a housing 110 having a laser material processing region, or processing chamber 112. The processing chamber 112 contains a laser beam delivery apparatus 130 ("beam delivery apparatus 130") configured to deliver a laser beam to material to be laser processed within the processing chamber 112. For example, the beam delivery apparatus 130 can be configured to weld or sinter materials, cut shapes or profiles out of materials, and mark or prepare materials by removing or modifying surface layers of materials.

The processing system 100 also includes a pressurized suppressant supply vessel, or suppressant tank 140, in fluid communication with the processing chamber 112 by a valve 142 and external fluid delivery conduit 143 ("external conduit 143"). As described in greater detail below, the suppressant tank 140 can include a suppressant that suppresses self-sustained combustion. The valve 142 is also electrically coupled to a first sensor 150*a* and a second sensor 150*b* (collectively "sensors 150") by a signal cable 152. The first sensor 150*a* is at least partially disposed in the processing chamber 112, and the second sensor 150*b* is at least partially disposed in an exhaust outlet 113 in fluid communication with the processing chamber 112. The sensors 150 can include, for example, thermal switches, flame sensors (e.g., ultraviolet (UV) light sensors), thermocouples, smoke detectors, or other suitable sensors or detectors for sensing the presence of self-sustained combustion. In one embodiment, for example, the sensors 150 can be thermal switches (e.g., bi-metal thermal switches) configured to have a specific switching temperature. For example, in some embodiments a thermal switch can have a switching temperature of about 150° F. In addition, although shown in the illustrated embodiment as disposed in the processing chamber 112 and the exhaust outlet 113, the sensors 150 can be positioned at any of a variety of locations within the processing system 100. Further, in several embodiments, the processing system 100 can include a different number of sensors than shown in the illustrated embodiment of FIG. 1A, such as three, four, or more sensors.

In some embodiments, the processing system 100 can include one or more redundant suppressant supply vessels, or redundant tanks 146 (shown in hidden lines). Each of the redundant tanks 146 can be coupled to the external conduit 143 (or directly to the processing chamber 112) by fluid delivery conduit 148 and a valve manifold 149 containing a plurality of valves (not shown). In use, the valve manifold 149 can automatically or semi-automatically switch over to one of the redundant tanks 146 after another one of the tanks 140, 146 has been discharged. In one aspect of this embodiment, the redundant tanks 146 can reduce system downtime. In particular, the processing system 100 can immediately or nearly immediately resume processing without having to suspend operation until a replacement tank is installed. In an additional or alternative embodiment, the suppressant tank 140 and the redundant tanks 146 can be configured to collectively dispense suppressant into the processing chamber 112 to increase the volume of suppressant delivered during a combustion detection event.

Figure 1B:
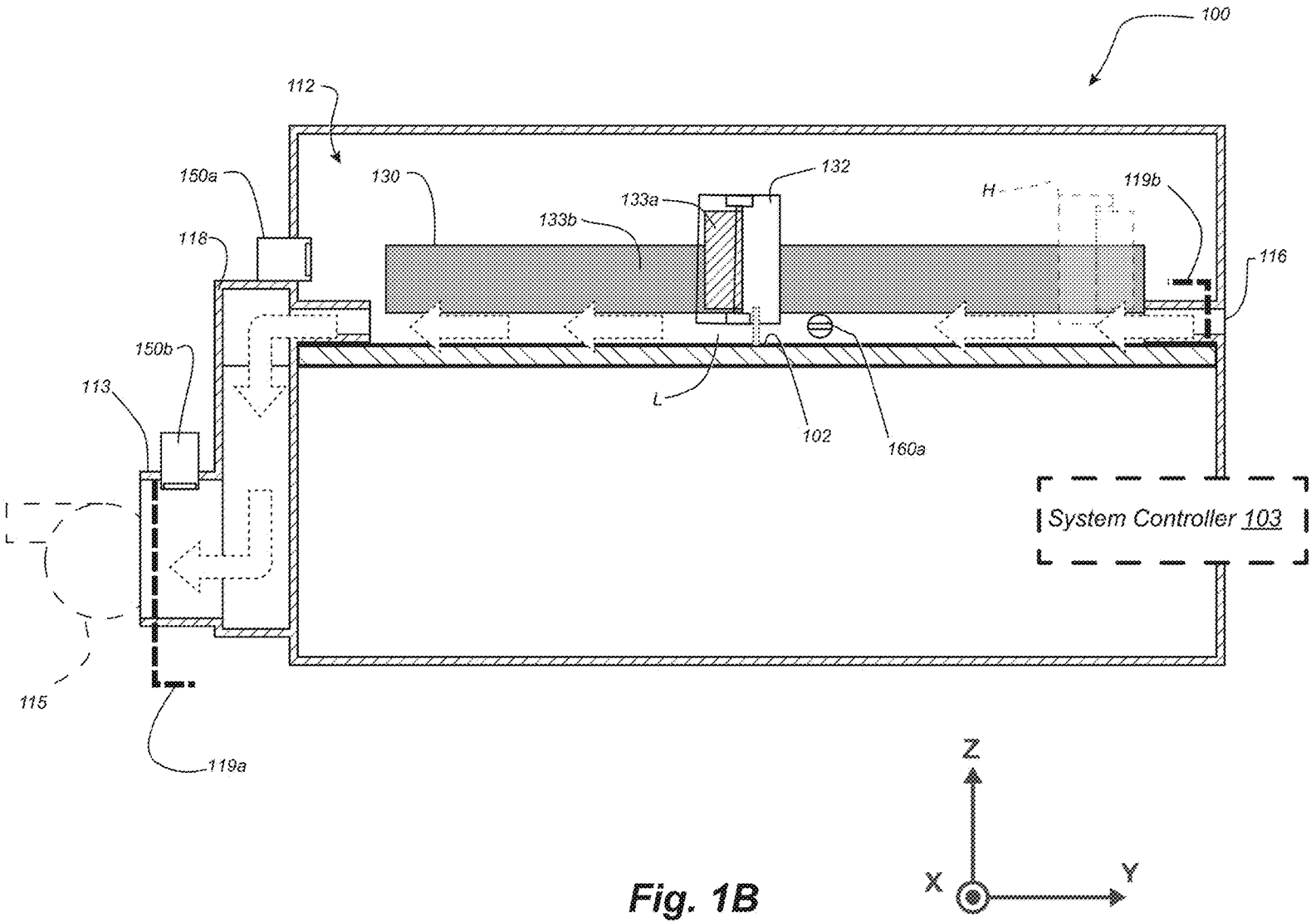
FIG. 1B is a cross-sectional view.

FIG. 1B is a cross-sectional view of the processing system 100 showing motion components of the beam delivery apparatus 130. More specifically, the motion components shown in FIG. 1B include a carriage assembly 132 moveably coupled to a first guide member 133*a*, such as a support beam. The first guide member 133*a*, in turn, can be moveably coupled to second guide members 133*b*, such as a pair of guide rails (only one second guide member 133*b* is visible in FIG. 1B). The beam delivery apparatus can include optics (not shown) that direct a laser beam from a laser source, such as $CO_2$ gas laser source (not shown) along the beam delivery path to a desired location. A portion of the optics can be positioned in the carriage assembly 132 and configured to guide a laser beam L toward a surface of a support plane, or work plane 102. A controller 103 (shown schematically) can be operably coupled to one or more motors (not shown) for moving the carriage assembly 132, and for moving the first guide member 133*a* on the second guide members 133*b*. In operation, the beam delivery apparatus 130 can move the laser beam L in the X- and Y-axis directions via the carriage assembly 132 and the first guide member 133*a*, respectively, to process materials (not shown) on the work plane 102.

During laser material processing, and as shown by the arrows, air can flow through the processing chamber 112 to remove byproducts of laser material processing (e.g., smoke and fumes) and to draw fresh air into the processing chamber 112. For example, an exhaust air handler 115 (e.g., a blower; shown schematically) can draw fresh air into the processing chamber 112 through an air inlet 116 and out of the processing chamber 112 through a plenum 118 disposed between the processing chamber 112 and the exhaust outlet 113. In one embodiment, the controller 103 can control the exhaust air handler 115 to regulate the flow of air through the processing chamber 112. In another embodiment described in greater detail below, when the presence of self-sustained combustion is detected, the controller 103 can shut off the exhaust air handler 115 and/or close an exhaust flow gate 119*a* (e.g., a damper) at the exhaust outlet and/or an exhaust flow gate 119*b* (e.g., a damper) at the air inlet 116. In yet another aspect of this embodiment, the controller 103 can be configured to move the beam delivery apparatus 130 to a position to minimize interference with the deployment of suppressant into the processing chamber 112. As shown in the embodiment of FIG. 1B, for example, the controller 103 may move the carriage assembly 132 to a home position H toward the air inlet 116 when the presence of self-sustained combustion is detected.

Figure 1C:
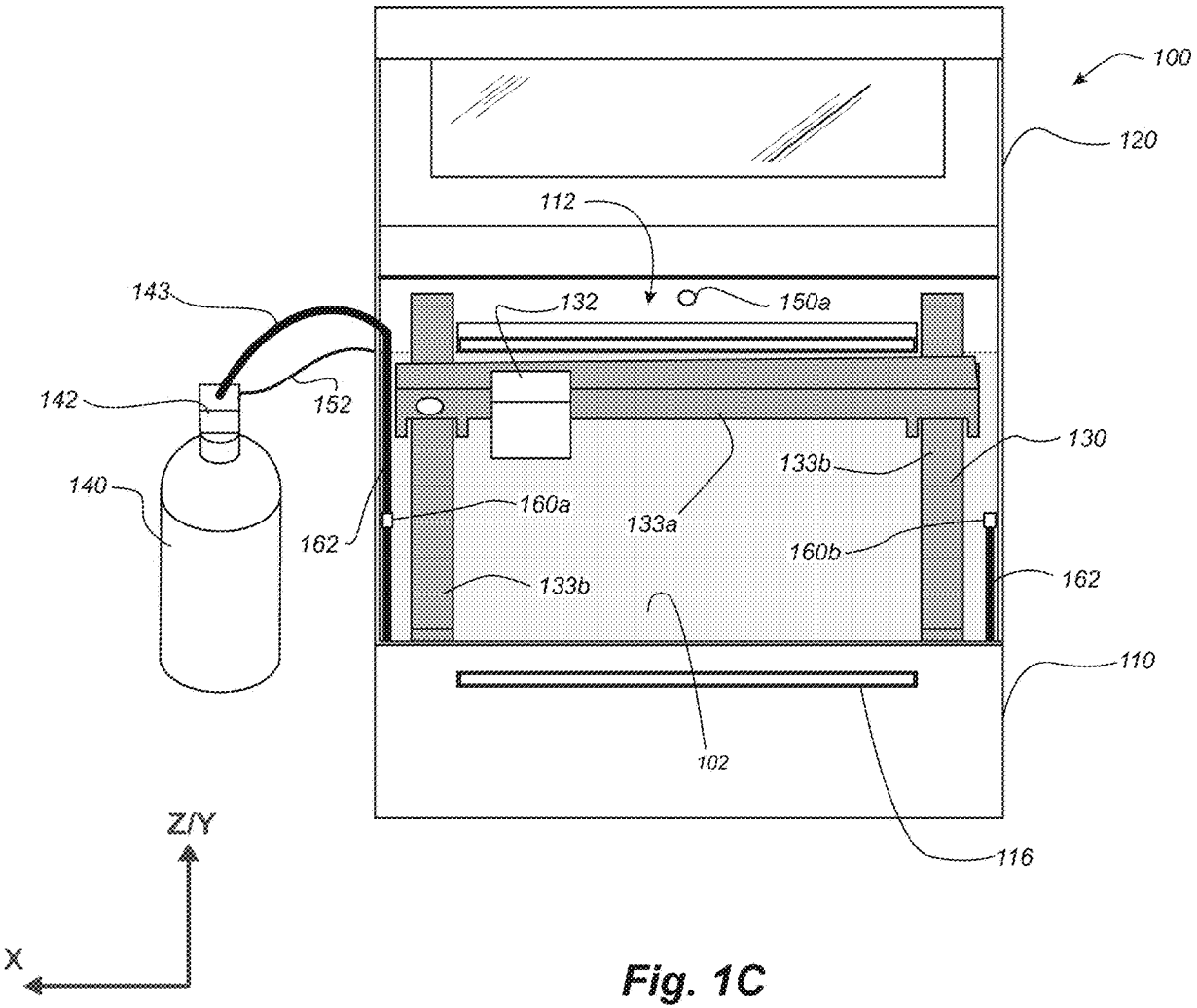
FIG. 1C is a front isometric view of a laser material processing system configured to suppress self-sustained combustion in accordance with an embodiment of the present technology.

FIG. 1C is a front isometric view of the processing system 100 with an access port 120 (e.g., a lid) of the processing chamber 112 opened. As shown, the suppressant tank 140 is coupled to first and second fluid suppressant delivery ports, or first and second nozzles 160*a* and 160*b* (collectively "nozzles 160"), via the external conduit 143 and internal fluid delivery conduit 162 ("internal conduit 162") within the housing 110. In operation, the nozzles 160 are configured to dispense suppressant into the processing chamber 112 when the sensors 150 detect the presence of self-sustained combustion. More specifically, in the illustrated embodiment of FIG. 1C, the sensors 150 can send a signal over the signal cable 152 to open the valve 142 of the suppressant tank 140, which, in turn, causes suppressant to flow to the nozzles 160 via the external and internal conduit 143 and 162.

Figure 2:
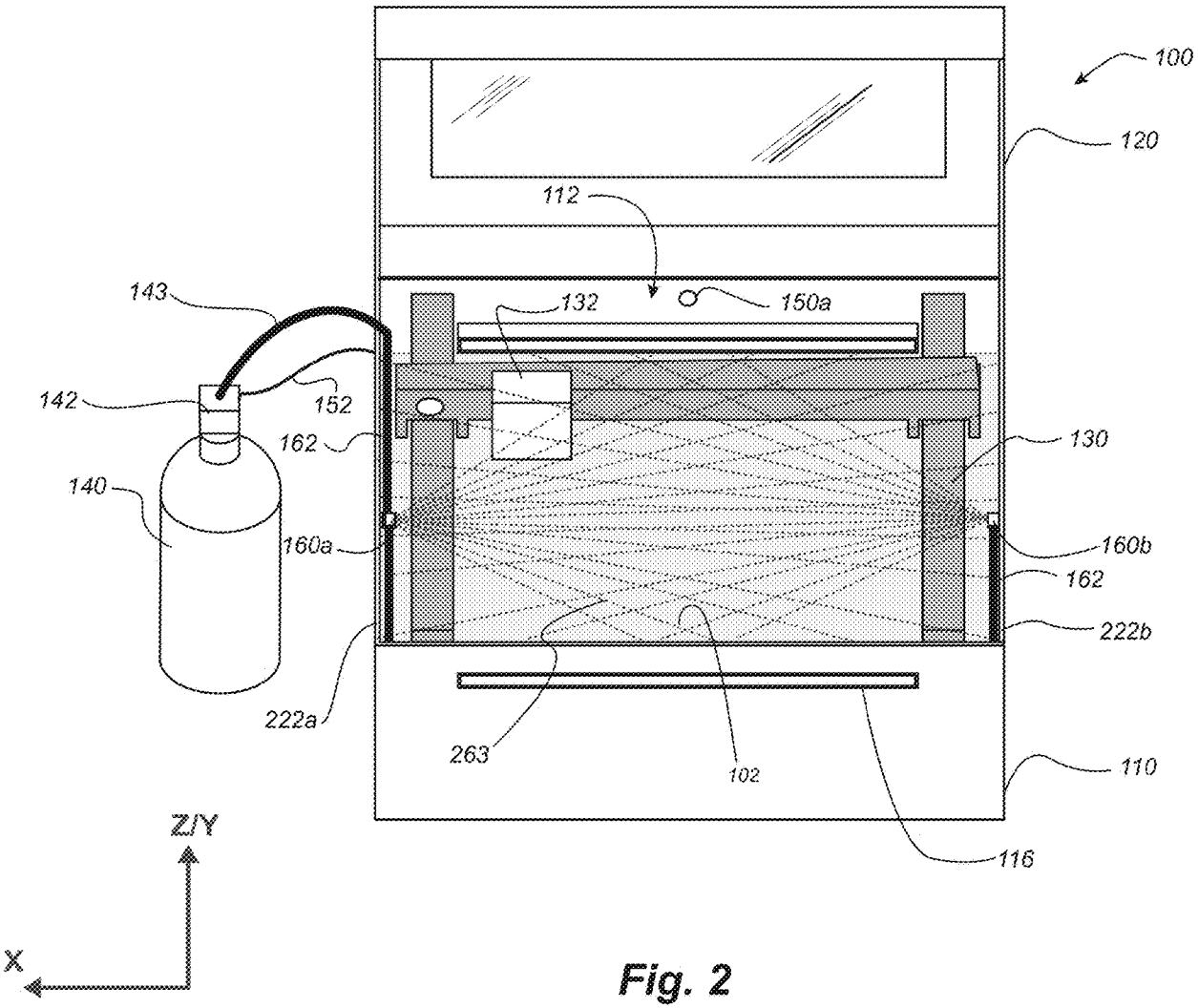
FIG. 2 is a front isometric view showing suppressant being dispensed into the laser material processing system of FIGS. 1A-1C in accordance with an embodiment of the present technology.

FIG. 2 is a front isometric view of the processing system 100 showing the nozzles 160 dispensing suppressant 263 ("suppressant 263") into the processing chamber 112. In the illustrated embodiment of FIG. 2, the access port 120 is open for purposes of illustration, but would typically be closed under normal processing conditions. As shown, the first nozzle 160*a* can spray the suppressant 263 from a first side 222*a* (e.g., the left side) of the processing chamber 112 and toward a second side 222*b* (e.g., the right side) of the processing chamber 112. The second nozzle 160*b* can spray from the second side 222*b* and toward the first side 222*a* to form an overlapping spray pattern with the suppressant 263 dispensed from the first nozzle 160*a*. In one aspect of this embodiment, the overlapping spray pattern can ensure that the suppressant 263 covers the entire work plane 102 or nearly all of the work plane 102. In other embodiments additional nozzles can be added to improve or increase coverage as necessary. In some embodiments, the suppressant 263 can be an engineered, non-toxic fluid. In several embodiments, the suppressant 263 can include, for example, a halogenated, hydrocarbon-replacement suppressant, such as Novec 1230, provided by 3M Company, or FM-200, provided by Dupont. In another embodiment, the suppressant 263 can be a powdered suppressant. In other embodiments, the suppressant 263 can be a water or an inert gas, such as $CO_2$, Nitrogen gas, or other gas that does not leave residue in the processing chamber 112.

In general, when an uncontrolled and self-sustaining fire ignites in a conventional laser material processing system, an operator typically must extinguish a fire with an off-the-shelf, manually operated fire extinguisher. One problem with extinguishing fire in this manner, however, is that manual extinguishers can leave messy residue when discharged, which can lead to hours of cleanup and possible damage to the machine system. Another challenge with conventional laser material processing systems is that an operator may not be able to open the processing chamber to extinguish the fire because there may be a risk of exposure to harmful fumes. Because the operator cannot immediately open the processing chamber, it may take longer to extinguish the fire and thus may lead to further damage to the machine system due to prolonged exposure to the fire.

Laser material processing systems configured in accordance with several embodiments of the present technology, however, address these and other limitations of conventional laser material processing systems. In one aspect of this embodiment, the suppressant 263 can be selected such that there is little or no clean-up after it has been dispensed. For example, inert gases or liquid-phase suppressants can leave little or virtually no residue in the processing chamber 112. Another advantage of the laser material processing systems of the various embodiments is that the operator does not need to open the access port 120 in order to suppress self-sustained combustion with a manual fire extinguisher.

In another aspect of this embodiment, the nozzles 160 can be configured to provide a high volumetric flow of the suppressant 263, but without substantially atomizing or vaporizing the suppressant 263. When in a liquid phase, the suppressant does not substantially atomize or vaporize (if at all). As such, the suppressant 263 can mostly flow downwardly and across the work plane 102 to smother or suppress self-sustained combustion. Also, the liquid-phase suppressant 263 is not rapidly drawn out of the processing chamber 112 by the exhaust.

Figure 3:
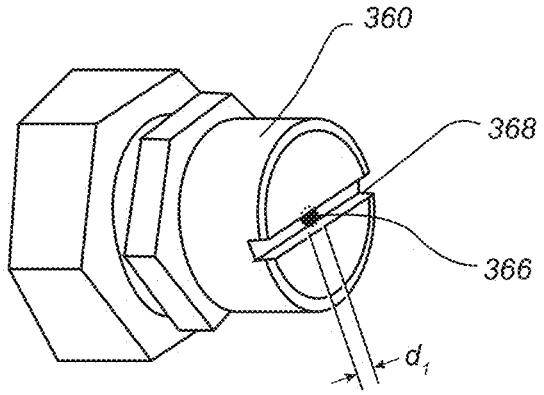
FIG. 3 is an isometric view of a suppressant delivery port configured in accordance with an embodiment of the present technology.

FIG. 3 shows a suppressant delivery port, or nozzle 360, configured in accordance with an embodiment of the present technology. As shown, the nozzle 360 includes a circular orifice 366 formed in a slot, or notch 368. The orifice 366 can have a diameter $d_1$ sized such that the suppressant 263 remains in liquid form when it exits the nozzle 360. For example, the diameter $d_1$ can be relatively larger for high viscosity fluids and relatively smaller for lower viscosity fluids. Also, the diameter $d_1$ can be sized based on the pressure of the suppressant tank 140. For example, the orifice 366 can be larger for suppressants delivered at a high pressure and smaller for suppressants delivered at relatively lower pressures. In some embodiments, the diameter $d_1$ can be in the range of about 0.5 mm to 5 mm (e.g., 1 mm). In an additional or alternate embodiment, the diameter $d_1$ can be selected to achieve a particular spray pattern of the suppressant 263.

Figure 4:
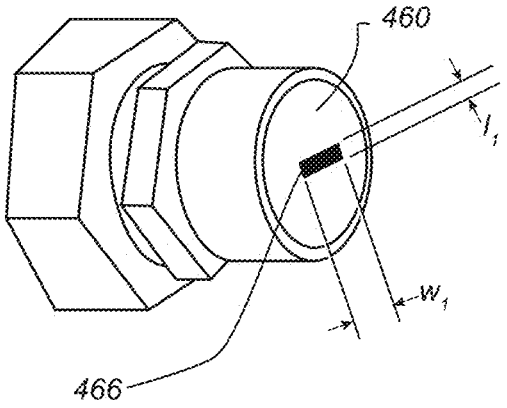
FIG. 4 is an isometric view of a suppressant delivery port configured in accordance with another embodiment of the present technology.

FIG. 4 shows a suppressant delivery port, or nozzle 460, configured in accordance with another embodiment of the present technology. The nozzle 460 can be similar in function as the nozzle 360 of FIG. 3. For example, the nozzle 460 can have an orifice 466 that is configured to dispense the suppressant 263 in liquid phase. As shown, the orifice 466 is non-circular (e.g., rectangular). In several embodiments, the orifice 466 can be configured to provide a different spray pattern (e.g., a wider spray pattern) than the orifice 366. In some embodiments, the orifice 466 can have a length $l_1$ in the range of about, e.g., 1 to 5 mm and a width $w_1$ in the range of about, e.g., 0.5 mm to 3 mm.

Figure 5:
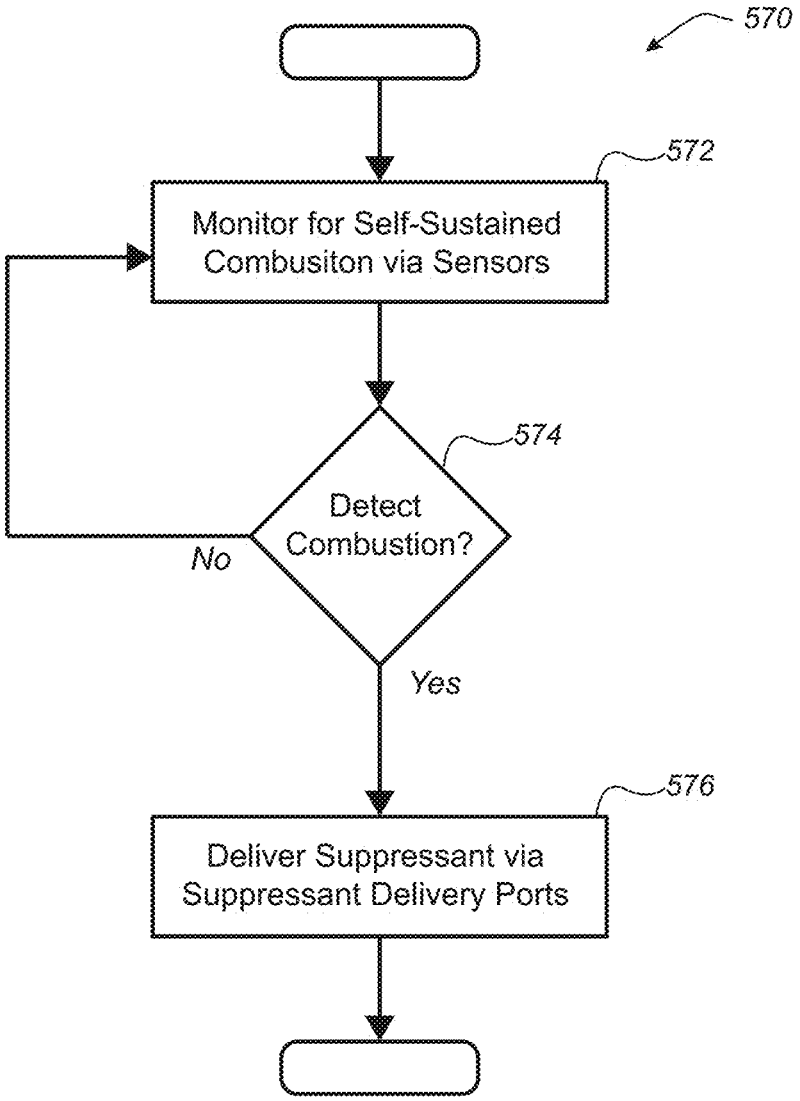
FIG. 5 is a flow diagram illustrating a method for suppressing self-sustained combustion in a laser material processing system in accordance with an embodiment of the present technology.

FIG. 5 is a flow diagram illustrating a method 570 for suppressing and/or preventing self-sustained combustion in a laser material processing system in accordance with an embodiment of the present technology. At block 572, the sensors 150 monitor the processing chamber 112 to detect the presence of self-sustained combustion. In one embodiment, for example, each of the sensors 150 can detect temperatures above a certain temperature threshold (e.g., a threshold of 150° F., 175° F., 200° F., or higher). In some embodiments, the temperature threshold can be selected based on the location at which a sensor is positioned in the processing system 100. For example, the first sensor 150*a* can be configured to have a higher (or lower) temperature threshold than the second sensor 150*b*. In an additional or alternate embodiment, the sensors 150 can detect smoke, such as a certain concentration and/or a particular type of smoke.

In various embodiments, the sensors 150 can be configured to distinguish between expected combustion (e.g., non-self-sustained combustion) in the processing chamber 112 and self-sustained combustion that is not expected. More specifically, the sensors 150 can be configured to distinguish between localized combustion at the point of interaction between the laser and the material to be laser processed and the combustion associated with self-sustained combustion, such as fire, that has spread beyond the point of interaction. For example, in one embodiment, if only the sensor proximal to the point of interaction (e.g., the first sensor 150*a*) detects combustion, the processing system 100 does not dispense the suppressant 263. However, if a less proximal sensor also detects combustion (e.g., the second sensor 150*b* and/or another sensor in the processing chamber 112), this can indicate that fire has spread beyond the point of interaction with the material to be laser processed, and the processing system can dispense the suppressant 263. As described in greater detail below with reference to FIGS. 6A-8, sensors can include other configurations for distinguishing between expected combustion and self-sustained combustion.

If the presence of self-sustained combustion is detected (decision block 574), the method 570 proceeds to block 576 at which point the suppressant 263 is delivered to the processing chamber 112 (block 576). As discussed above, at least one the sensors 150 can send a signal over the signal cable 152 which causes the valve 142 of the suppressant tank 140 to open and thereby dispense the suppressant 263 into the processing chamber 112 via the nozzles 160. In one embodiment, the valve 142 can remain open such that substantially all of the suppressant in the suppressant tank 140 is dispensed into the processing chamber 112. In an additional or alternate embodiment, the suppressant 263 can be dispensed for a predetermined duration of time (e.g., a dispense time in the range of about 15 to 30 seconds).

In some embodiments, the sensors 150 can open the valve 142 even if the controller 103 were to malfunction or otherwise fail. For example, in the illustrated embodiments, the sensors 150 are not connected to the controller 103. Instead, the signal cable 152 directly connects the sensors 150 to the valve 142. In other embodiments, however, the controller 103 can be an intermediary between the sensors 150 and the valve 142.

In several embodiments, the controller 103 can carry out certain functions when the presence of self-sustained combustion is detected. For example, the controller 103 can produce a signal that causes an audible and/or visible alarm to activate, one or both of the exhaust flow gates 119*a* and 119*b* to close, and/or the beam delivery apparatus 130 to move to a predetermined position, such as the home position H shown in FIG. 1B. Once it is determined that self-sustained combustion has been suppressed, any damaged material can be removed from the processing chamber 112. In one embodiment, the controller 103 can interlock the processing system 100 for laser material processing until the suppressant tank 140 is refilled and/or replaced. For example, the controller 103 can be configured to monitor the pressure of the suppressant tank 140 and detect whether the suppressant tank 140 has been recharged. In other embodiments that include one or more of the redundant tanks 146, the controller 103 can be configured to communicate with the valve manifold 149 to switch over from a discharged tank to a non-discharged tank, as discussed above.

Figure 6A:
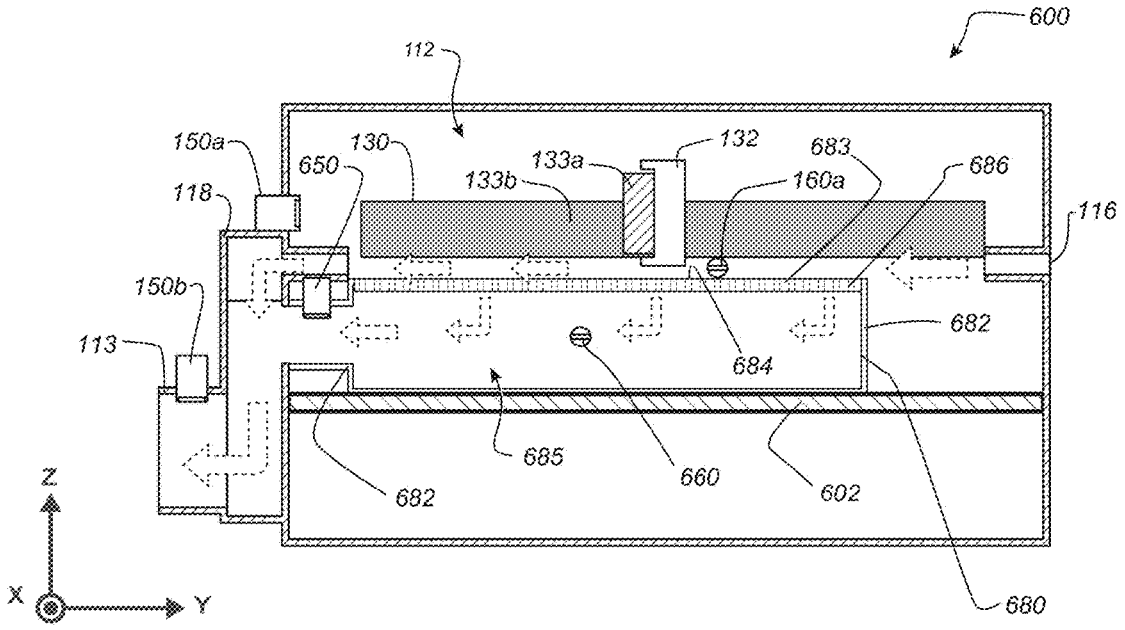
FIG. 6A is a cross-sectional view of a laser material processing system configured in accordance with another embodiment of the present technology.
Figure 6B:
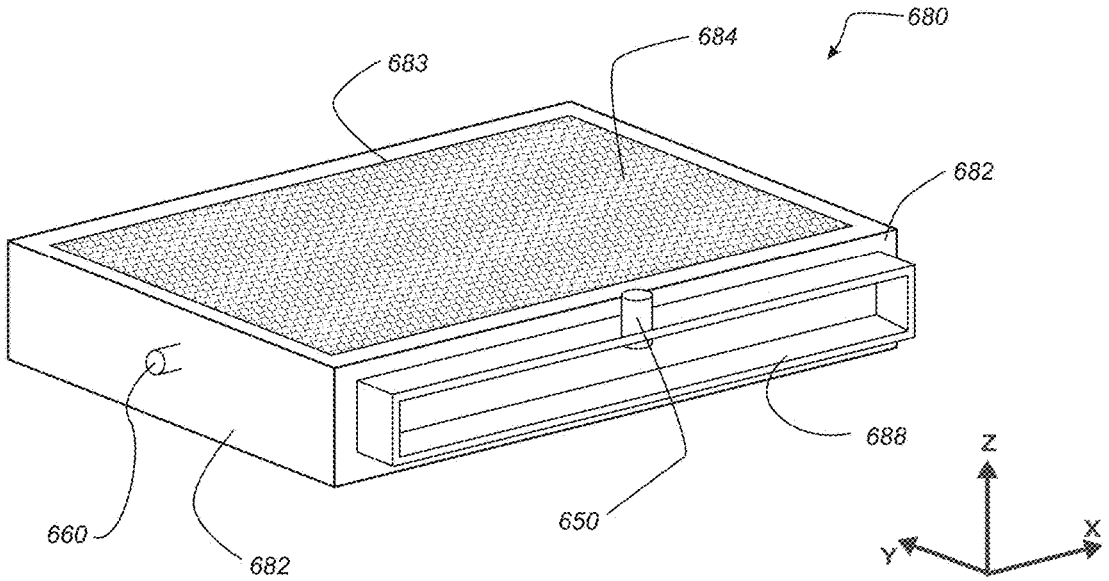
FIG. 6B is an isometric view showing a removable platform of the laser material processing system in further detail.

FIG. 6A is a cross-sectional view of a laser material processing system 600 ("processing system 600") configured in accordance with an embodiment of the present technology, and FIG. 6B is an isometric view showing a removable platform, or material support structure 680 (e.g., a cutting table), of the processing system 600 in more detail. The processing system 600 can be generally similar in structure and function as the processing system 100 described in detail above. For example, the processing system 600 includes the processing chamber 112 containing the beam delivery apparatus 130.

Referring first to FIG. 6A, the material support structure 680 is positioned in the processing chamber 112 below the beam delivery apparatus 130 on a support plane 602. The material support structure 680 includes wall portions 682 and an air permeable wall portion 683 ("permeable wall 683") that together define an enclosure 685. As best seen in FIG. 6B, the permeable wall 683 can define a support plane, or work plane 684, and can include, for example, an open-cell structure 686 (e.g., a honeycomb structure) that makes minimal contact with a material to be laser processed (not shown) and improves exhaust efficiency. At least one suppressant delivery port 660, or nozzle 660, can be coupled to the internal conduit 162 (FIG. 1C) and configured to deliver the suppressant 263 into the enclosure 685 when the presence of self-sustained combustion is detected. In the illustrated embodiment, the material support structure 680 includes an additional sensor 650 coupled to an air outlet 688 of the material support structure 680 to detect the presence of self-sustained combustion that may occur within or near the enclosure 685. In one aspect of this embodiment, the sensor 650 as well as the sensors 150 can detect the presence of self-sustained combustion that may occur due to accumulation of material below the open-cell structure 686.

Referring again to FIG. 6A, the air outlet 688 can be in fluid communication with the exhaust outlet 113 via the plenum 118. As shown by the arrows, the exhaust air handler 115 (FIG. 1B) can draw air through the permeable wall 683 and into the enclosure 685 via the air outlet 688. In one aspect of this embodiment, the exhaust air handler 115 can apply suction that causes the material to be laser processed to be held down against the permeable wall 683, thereby securing the material during processing.

Figure 7:
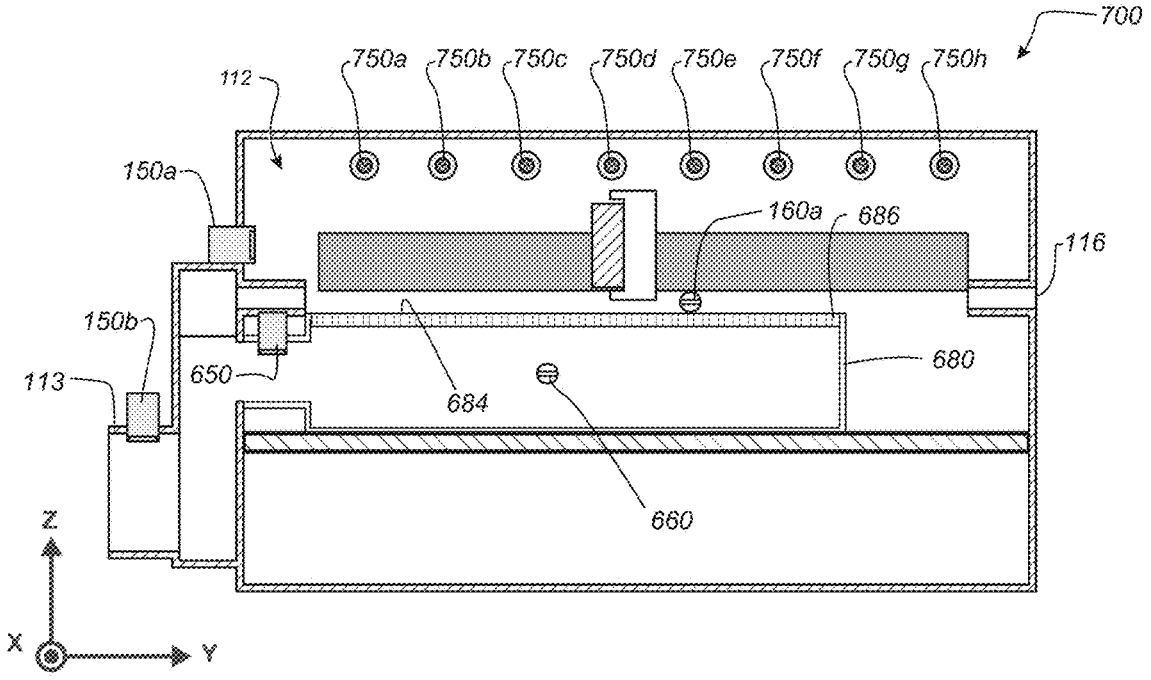
FIG. 7 is a cross-sectional view of a laser material processing system configured in accordance with another embodiment of the present technology.

FIG. 7 is a cross-sectional view of a laser material processing system 700 ("processing system 700") configured in accordance with another embodiment of the present technology. The processing system 700 can be generally similar in structure and function as the processing systems described in detail above. As shown, the processing system 700 includes a plurality of sensors 750*a-f* (collectively "sensors 750") arranged in an array and generally above the material support structure 680. The sensors 750 can each include the same type of sensor (e.g., a UV sensor) or different types of sensors (e.g., temperature sensors and UV sensors). In one aspect of the illustrated embodiment, the processing system 700 determines the presence of self-sustained combustion when two or more of the sensors 750 detect combustion, such as when both a temperature sensor and a UV sensor detect combustion. In another aspect of this embodiment, the multiple sensors 750 can address issues such as time delay and line of sight limitations that can be associated with conventional sensor configurations.

In some embodiments, the processing system 700 can determine the presence of self-sustained combustion based on the rate in change of detected temperature over time ($\Delta T/t$) and by comparing this measurement to a threshold value, such as a threshold rate of change in temperature. For example, the processing system 700 can determine the presence of self-sustained combustion when two or more of the sensors 750 detect a rapid change in temperature that exceeds the threshold. In addition or alternately, the processing system 700 can determine the presence of self-sustained combustion based on the relative location of the triggered sensors. For example, if sensors 750*c* and 750*d* detect combustion at the same time, this could be indicative of expected combustion. However, if sensors 750*c* and 750*e* (or even further spaced apart sensors) detect combustion at the same time, the could be indicative of the presence of self-sustained combustion.

Figure 8:
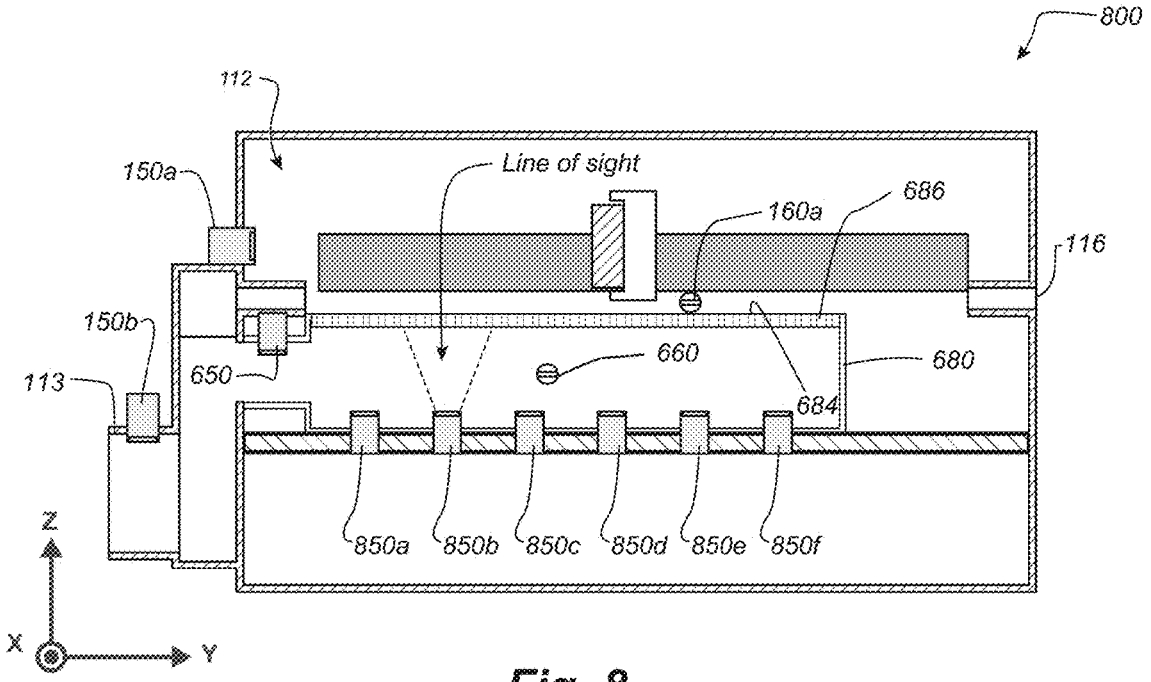
FIG. 8 is a cross-sectional view of a laser material processing system configured in accordance with another embodiment of the present technology.

FIG. 8 is a cross-sectional view of a laser material processing system 800 ("processing system 800") configured in accordance with another embodiment of the present technology. The processing system 800 can be generally similar in structure and function as the processing systems described in detail above. As shown, the processing system 800 includes a plurality of sensors 850*a-f* (collectively "sensors 850") arranged in an array and disposed within the material support structure 680. Similar to the processing system 700 (FIG. 7), the processing system 800 can determines the presence of self-sustained combustion when two or more of the sensors 850 detect combustion. In one aspect of the illustrated embodiment of FIG. 8, the sensors 850 can detect for combustion that may occur within the open cell structure (e.g., combustion of materials trapped within one or more of the open cells). In one embodiment, the sensors 850 can be UV sensors that each have an associated line of sight that overlaps with the line of sight of an adjacent UV sensor.

From the foregoing, it will be appreciated that specific embodiments of the present technology have been described herein for purposes of illustration, but that various modifications may be made without deviating from the spirit and scope of the various embodiments of the present technology. Moreover, because many of the basic structures and functions of laser material processing systems are known, they have not been shown or described in further detail to avoid unnecessarily obscuring the described embodiments. Further, while various advantages and features associated with certain embodiments of the disclosure have been described above in the context of those embodiments, other embodiments may also exhibit such advantages and/or features, and not all embodiments need necessarily exhibit such advantages and/or features to fall within the scope of the disclosure.

The invention claimed is:

1. A laser material processing system, comprising:

a laser material processing region including a processing chamber and a laser beam delivery apparatus within the processing chamber;

one or more sensors disposed in the laser material processing region and configured to detect self-sustained combustion in the laser material processing region;

an air inlet positioned to draw a flow of air through the laser material processing region;

an exhaust outlet for exhausting the air from the laser material processing region;

and two or more suppressant delivery ports positioned in or adjacent to the laser material processing region, wherein the suppressant delivery ports include a first suppressant delivery port at a first wall of the processing chamber and a second suppressant delivery port at a second wall of the processing chamber, and wherein the first and second walls are at opposite sides of the processing chamber, wherein the laser material processing system is configured to distinguish between non-self-sustained combustion and self-sustained combustion, and wherein the first and second suppressant delivery ports are configured to deliver a suppressant to the laser material processing region when at least one of the one or more sensors detects the presence of self-sustained combustion.

2. The laser material processing system of claim 1 wherein:

at least one of the one or more sensors is configured to sense the temperature within the processing chamber; and the suppressant delivery ports deliver the suppressant into the processing chamber when the at least one of the one or more sensors senses a that the temperature within the processing chamber exceeds a temperature threshold.

3. The laser material processing system of claim 1, further comprising:

at least one pressurized suppressant supply vessel containing the suppressant; and at least one valve fluidly coupled between the at least one suppressant supply vessel and the suppressant delivery ports, wherein the valve is configured to be activated in the event of the presence of self-sustained combustion.

4. The laser material processing system of claim 1, further comprising one or more additional sensors configured to detect self-sustained combustion, wherein at least one of the one or more additional sensors is disposed in the exhaust outlet.

5. The laser material processing system of claim 1 wherein the one or more sensors include at least one of a thermal switch, a flame sensor, and a thermocouple.

6. The laser material processing system of claim 1 wherein the laser beam delivery apparatus in the laser material processing region includes one or more motion components, and wherein one or more of the one or more motion components is configured to move to a location that minimizes interference with deployment of the suppressant when at least one of the one or more sensors detects the presence of self-sustained combustion.

7. The laser material processing system of claim 1 wherein the suppressant is a halogenated hydrocarbon-replacement suppressant.

8. The laser material processing system of claim 7 wherein the suppressant delivery ports are further configured to deliver the suppressant without atomizing or vaporizing the suppressant.

9. The laser material processing system of claim 1 wherein the suppressant is water or a water based solution.

10. The laser material processing system of claim 1 wherein the suppressant is an inert gas.

11. The laser material processing system of claim 1 wherein the suppressant is a solid suppressant.

12. The laser material processing system of claim 1, further comprising a support plane and a material support structure on the support plane, the material support structure defining a work plane and configured to support a material to be laser processed on the work plane, wherein at least one of the suppressant delivery ports is positioned to deliver suppressant between the work plane and the support plane.

13. The laser material processing system of claim 12 wherein at least one of the one or more sensors is located between the work plane and the support plane.

14. The laser material processing system of claim 12 wherein:

the material support structure includes an open-cell structure in fluid communication with the exhaust outlet; and the open-cell structure is configured to define the work plane.

15. The laser material processing system of claim 1, further comprising:

a plurality of suppressant supply vessels coupled to the suppressant delivery ports; and a plurality of valves fluidly coupled between the plurality of suppressant supply vessels and the suppressant delivery ports, wherein the valves are configured to switch over from a discharged one of the suppressant supply vessels to a non-discharged one of the suppressant vessels.

16. The laser material processing system of claim 1, further comprising a controller, an exhaust flow gate coupled to the controller, and an exhaust air handler in fluid communication with the laser material processing region via the exhaust flow gate for exhausting laser processing byproducts, wherein the controller closes the exhaust flow gate to inhibit the flow of air when the self-sustained combustion is detected in the laser material processing region.

17. The laser material processing system of claim 1, further comprising a controller and an exhaust flow gate operably coupled to the controller, adjacent the air inlet, and in fluid communication with the laser material processing region, wherein the controller closes the exhaust flow gate when the self-sustained combustion is detected in the laser material processing region.

18. A laser material processing system, comprising:

a processing chamber having a first wall and a second wall opposite the first wall;

a laser material processing region within the chamber;

a laser beam delivery apparatus within the chamber;

an air inlet arranged to draw a flow of air into the chamber;

an exhaust outlet for exhausting the air from the laser material processing region;

one or more sensors disposed in the laser material processing region;

at least one valve operably coupled to the one or more sensors, wherein the laser material processing system is configured to distinguish between non-self sustained combustion and self-sustained combustion, and wherein the at least one valve is configured to activate upon detection of self-sustained combustion in the laser material processing region;

at least one fluid delivery conduit arranged to receive a suppressant upon activation of the at least one valve; and two or more suppressant delivery ports fluidly coupled to the at least one fluid conduit and positioned in the laser material processing region for delivering the suppressant within the processing chamber upon the activation of the at least one valve, wherein the suppressant delivery ports include a first suppressant delivery port proximate the first wall of the processing chamber and a second suppressant delivery port proximate the second wall.

19. A fire safety mechanism for a laser cutting and engraving machine, wherein the laser cutting and engraving machine includes a machine body, a laser processing mechanism provided in the machine body, and a work platform, and wherein the laser processing mechanism is mounted on a work track and movable along the work track to cut or engrave a workpiece provided on the work platform, wherein the fire safety mechanism comprises:

one or more sensors in the machine body and configured to distinguish between non-self-sustained combustion and self-sustained combustion;

a fire extinguishing unit, wherein the fire extinguishing unit includes a nozzle within the machine body and positioned to deliver a suppressant toward the work platform; and a control unit electrically coupled to the one or more sensors and the fire extinguishing unit, wherein the control unit is configured to (a) receive and process a signal delivered from the one or more sensors if the one or more sensors detects a presence of self-sustained combustion at or near the work platform within the machine body and (b) activate the fire extinguishing unit such that the nozzle delivers the suppressant toward the work platform, one or more motion components configured to move the laser processing mechanism to a location that minimizes interference with deployment of the suppressant via the nozzle when the control unit receives the signal from the one or more sensors detecting the presence of self-sustained combustion within the machine body.

20. The fire safety mechanism of claim 19 wherein the individual sensors of the one or more sensors comprise a smoke sensor, a thermal switch, sensor, or a thermocouple.

* * * * *